US005869421A

United States Patent [19]

Kutami et al.

[11] Patent Number: 5,869,421

[45] Date of Patent: Feb. 9, 1999

[54] REVERSIBLE THERMOSENSITIVE RECORDING MATERIAL

[75] Inventors: Atsushi Kutami; Tohru Nogiwa; Fumihito Masubuchi, all of Shizuoka; Haruhiro Horiuchi, Fukui; Tetsuya Amano, Shizuoka, all of Japan

[73] Assignee: Ricoh Company, Ltd., Tokyo, Japan

[21] Appl. No.: 916,187

[22] Filed: Aug. 21, 1997

[30] Foreign Application Priority Data

Aug. 22, 1996 [JP] Japan ..... 8-238663

[51] Int. Cl.[6] ..... B41M 5/34

[52] U.S. Cl. ..... 503/201; 503/208; 503/209; 503/214

[58] Field of Search ..... 503/201, 208, 503/209, 214

[56] References Cited

FOREIGN PATENT DOCUMENTS 5-193258 8/1993 Japan ..... 503/201

*Primary Examiner*—Bruce H. Hess
*Attorney, Agent, or Firm*—Cooper & Dunham LLP

[57] ABSTRACT

A reversible thermosensitive recording material has a support and a reversible thermosensitive recording layer formed thereon, capable of reversibly assuming at least two different visible states depending upon the temperature thereof, containing an organic low-molecular weight material and a resin composition in which the organic low-molecular weight material is dispersed, the resin composition including a matrix resin, and a dispersion resin which has a glass transition temperature higher than that of the matrix resin, and having resin aggregates which are separately dispersed in the matrix resin in such a manner that the resin aggregates are associated with the matrix resin.

10 Claims, 4 Drawing Sheets

(x 40,000)

(x78,000)

(x750)

REVERSIBLE THERMOSENSITIVE RECORDING MATERIAL

BACKGROUND OF THE INVENTION

1. Field of the Invention

The present invention relates to a reversible thermosensitive recording material, and more particularly to a reversible thermosensitive recording material capable of writing (or displaying) information in a reversible thermosensitive recording layer of the recording material and erasing the same information therefrom utilizing the property that the transparency or color tone of the recording layer is reversibly changeable depending upon the temperature thereof.

2. Discussion of the Background

The conventional reversible thermosensitive recording materials have the drawback that a reversible thermosensitive recording layer is easily damaged by the application of heat and pressure thereto when the writing and erasing operations are repeatedly carried out using a thermal head.

To eliminate the above-mentioned drawback, it is proposed that a thermosetting resin (in Japanese Laid-Open Patent Application 7-132681); and an electron irradiation curing resin or ultraviolet curing resin (in Japanese Laid-Open Patent Application 7-172072) are employed for the formation of a reversible thermosensitive recording layer.

However, when the thermosetting resin is used for the formation of the recording layer, the setting of the recording layer proceeds with time, thereby changing the reversibility of the recording layer.

In addition, when the resin for use in the recording layer is subjected to electron irradiation curing, the curing reaction involves deoxidation. As a result, the color change takes place in the recording layer, and a support under the recording layer is readily corroded when a metal-deposited support is employed.

Furthermore, in the case where the recording layer is formed by curing the ultraviolet curing resin, the image contrast becomes poor after the repeated writing and erasing operations. The reason for such insufficient image contrast is that particles of an organic low-molecular weight material become large, so that refraction happens at the interfaces between the large particles of the organic low-molecular weight material and a binder agent in the recording layer, and therefore, the recording layer tends to be opaque as a whole.

In Japanese Laid-Open Patent Application 5-193258, there is disclosed a reversible thermosensitive recording material comprising a support, and an anchor layer and a reversible thermosensitive recording layer which are successively overlaid on the support. According to this application, spacer particles in the form of sphere, branch, and needle are dispersed in the recording layer or the anchor layer in order to prevent the decrease of the milky whiteness degree of the recording layer and improve the durability of the recording layer. Although the durability of the recording layer is considerably improved in fact, the image contrast is still insufficient for practical use.

SUMMARY OF THE INVENTION

Accordingly, a first object of the present invention is to provide a reversible thermosensitive recording material free from the conventional problems, capable of preventing the deterioration of the erasing performance after storage of the recording material; improving the durability of the recording material, including the heat resistance thereof; and producing images with high image contrast.

A second object of the present invention is to provide a reversible thermosensitive recording material capable of showing optimal transparency and milky whiteness degree.

A third object of the present invention is to provide a reversible thermosensitive recording material capable of erasing recorded images by the application of thermal energy thereto, with the permissible range of thermal energy to be applied for image erasure being wide, and with the above-mentioned permissible thermal energy range being stable during the repeated operations.

A fourth object of the present invention is to provide a reversible thermosensitive recording material with excellent sensitivity for the erasing and writing operations.

The above-mentioned objects of the present invention can be achieved by a reversible thermosensitive recording material comprising a support and a reversible thermosensitive recording layer formed thereon, capable of reversibly assuming at least two different visible states depending upon the temperature thereof, comprising an organic low-molecular weight material and a resin composition in which the organic low-molecular weight material is dispersed. The above-mentioned resin composition comprises a matrix resin, and a dispersion resin which has a glass transition temperature higher than that of the matrix resin, and comprises resin aggregates. In this case, the resin aggregates are separately dispersed in the matrix resin in such a manner that the resin aggregates are associated with the matrix resin.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

According to the present invention, a reversible thermosensitive recording layer of the reversible thermosensitive recording material comprises a low-molecular weight material and a resin composition in which the low-molecular weight material is dispersed. The above-mentioned resin composition for use in the recording layer comprises a matrix resin, and a dispersion resin having a glass transition temperature higher than that of the aforementioned matrix resin. The dispersion resin comprises resin aggregates, which are separately dispersed in the matrix resin in such a manner that the resin aggregates are associated with the matrix resin.

Alternatively, the resin aggregates may be formed into groups which are separately dispersed in the matrix resin.

In this case, it is preferable that each resin aggregate of the dispersion resin be in the form of a microgel. When such a microgel has a particle diameter of 100 to 10,000 Å, the durability of the recording layer can be improved effectively without the decrease of image contrast.

According to the present invention, the above-mentioned dispersion resin works to prevent the deterioration of the matrix resin with time during the repeated image forming and erasing operations. Thus, it is possible to solve the previously mentioned problems caused by the conventional recording layer, that is, the increase of curing degree with time caused by the use of a thermosetting resin, the decomposition of the matrix resin and the corrosion of the support material caused by the use of an electron irradiation curing resin, and the deterioration of erasing performance caused by the use of an ultraviolet curing resin.

Any resin used as the matrix resin in the conventional reversible thermosensitive recording layer is usable as the matrix resin in the present invention. For example, there can be employed vinyl chloride polymer, vinyl chloride copolymer and vinylidene chloride copolymer as the matrix resin.

Figure 3A:
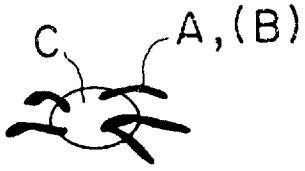
FIGS. 3(*a*) and 3(*b*) are schematic views, each showing the association between the resin aggregate of a dispersion resin C and a matrix resin A.
Figure 3B:
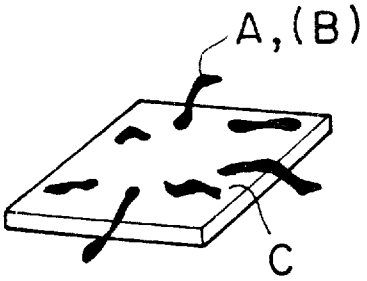

FIG. 3(*a*) is an enlarged schematic view which shows a dispersion resin in the form of a microgel for use in the reversible thermosensitive recording layer. As shown in FIG. 3(*a*), a dispersion resin C and a matrix resin A (or a mixture of the matrix resin A and an additional matrix resin component B to be described later) are mingled together to form an associated structure.

Figure 5:
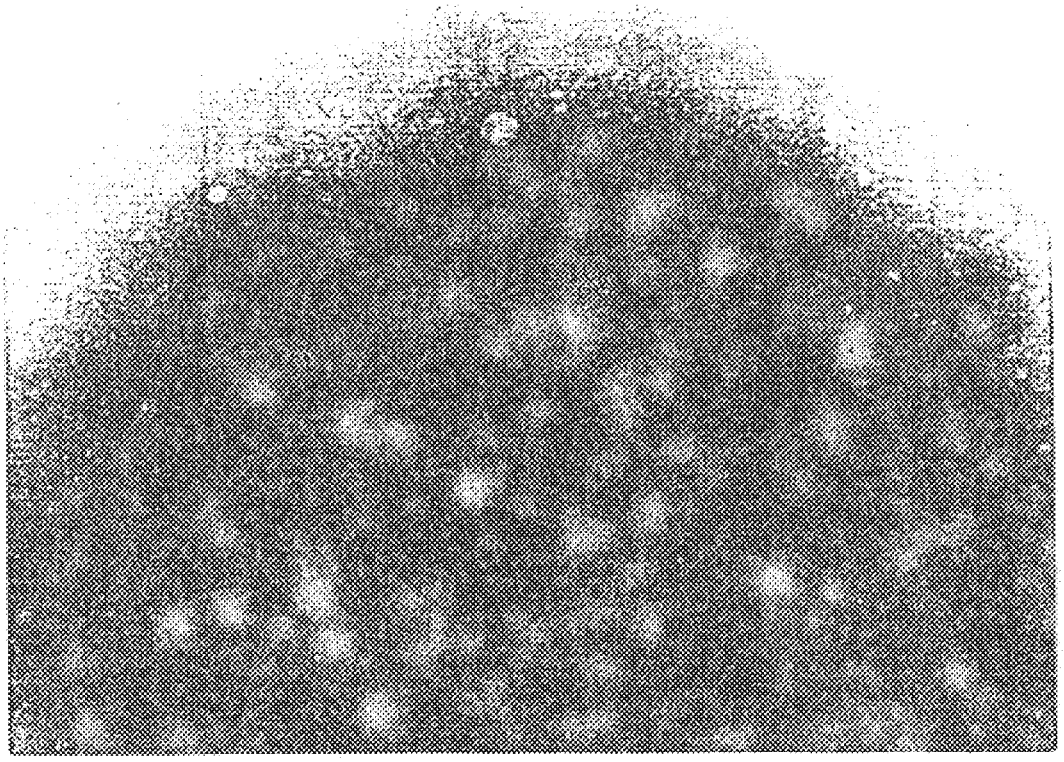
FIGS. 5 and 6 are electron micrographs, each showing an insoluble matter of the formulation for a reversible thermosensitive recording layer, which is obtained by dissolving the reversible thermosensitive recording layer in tetrahydrofuran.
Figure 6:
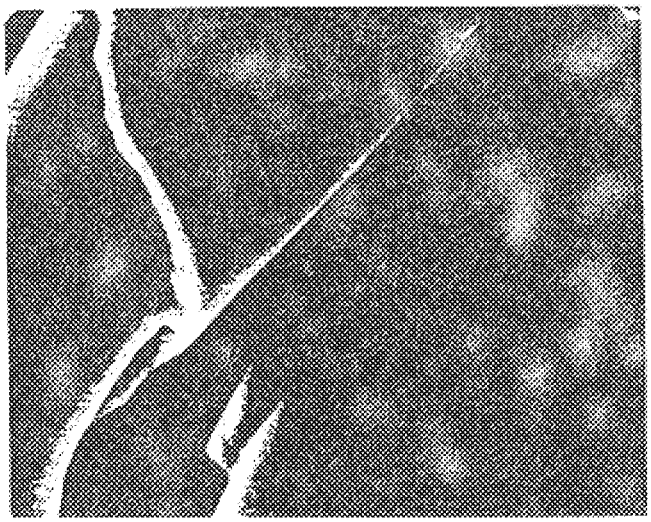

For example, when the reversible thermosensitive recording layer coated on the support is dissolved in tetrahydrofuran, the resin composition of the recording layer is soluble except the above-mentioned associated form of the matrix resin A and the dispersion resin C. FIGS. 5 and 6 are electron micrographs, each showing an insoluble matter of the associated resin composition sedimented in tetrahydrofuran. In FIG. 5, a resin aggregate of the dispersion resin C is in the form of a microgel; and a resin aggregate of the dispersion resin C is in the form, of a plate in FIG. 6.

The conventional reversible thermosensitive recording layer tends to be deformed by the application of heat and pressure thereto when the recording and erasing operations are repeated using a thermal head. However, in the recording layer of the reversible thermosensitive recording material according to the present invention, the resin aggregates of the dispersion resin C are mingled with the matrix resin A to form art associated structure, so that the deformation of the recording layer can be effectively prevented. Thus, the durability of the recording layer can be improved without any physical change after the storage of the reversible thermosensitive recording material.

From the viewpoint of improvement in the durability of the recording layer, it is further preferable that each resin aggregate of the dispersion resin C be in the form of a plate, with being mingled with the matrix resin A (or a mixture of the matrix resin A and the additional matrix resin component B), as shown in FIG. 3(*b*), in the reversible thermosensitive recording layer, In this case, it is preferable that the plate made of the resin aggregate have a thickness of 1 to 10 $\mu$m and a long side of 1 to 30 nm.

When the hardness of the dispersion resin C is high and the glass transition temperature thereof is higher than that of the matrix resin A, the deformation of the reversible thermosensitive recording layer can be effectively prevented. Generally, it is preferable that the glass transition temperature of the dispersion resin C be 180° C. or more.

It is preferable that the amount ratio by weight of the dispersion resin C to the matrix resin A be in the range of (1:99) to (40:60). When the amount ratio by weight of the dispersion resin C is too much in the recording layer, the reversibility of the recording layer is impaired, so that the image formation and erasure cannot be repeatedly carried out. On the other hand, when the dispersion resin C is contained in an excessively small amount in the recording layer, the recording layer deteriorates with time and the durability of the recording layer cannot be improved.

The dispersion resin C for use in the present invention can be prepared by curing at least one ultraviolet-curing acryl monomer such as an acryl ester monomer, acryl urethane monomer, or acryl epoxy monomer by the application of ultraviolet light thereto in the presence of a photopolymerization initiator. In particular, acryl ester monomer and acryl urethane monomer are preferably employed in the present invention. Further, it is advantageous that a mixture of the matrix resin A and the above-mentioned acryl monomer for use in the dispersion resin C be subjected to ultraviolet curing treatment.

It is preferable that the resin composition for use in the reversible thermosensitive recording layer have a dynamic viscoelasticity in a range of $10^5$ dyn/cm$^2$ to less than $10^7$ dyn/cm$^2$ when the resin composition is in the rubbery condition. When the dynamic viscoelasticity of the resin composition is within the above-mentioned range, the obtained recording layer is not too hard and fragile, and the deformation of the low-molecular weight material dispersed in the recording layer can be prevented so as to increase the durability of the recording layer.

Specific examples of the acryl monomer for obtaining the dispersion resin C are as follows:

[Acryl monomer of formula (1)]

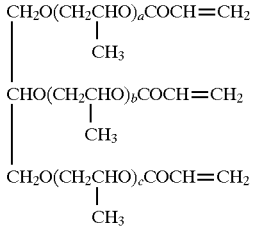

(1)

wherein a+b+c=3.6.

[Acryl monomer of formula (2)]

-continued (2)

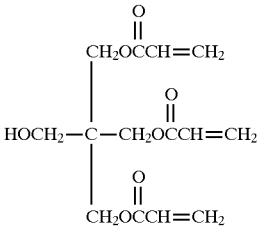

[Acryl monomer of formula (3)]

(3)

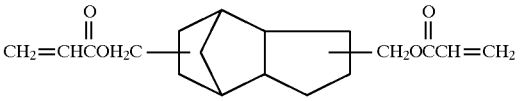

[Acryl monomer of formula (4)]

(4)

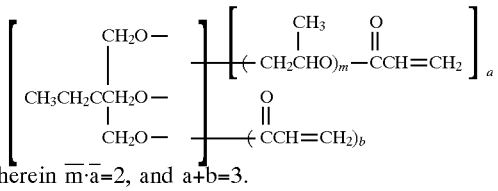

wherein $\overline{m}\cdot\overline{a}=2$, and a+b=3.

[Acryl monomer of formula (5)]

(5)

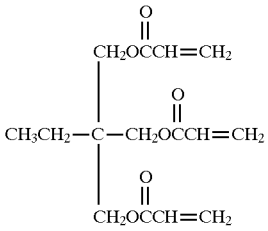

[Acryl monomer of formula (6)]

(6)

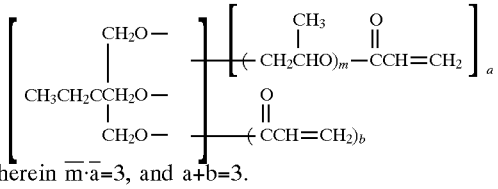

wherein $\overline{m}\cdot\overline{a}=3$, and a+b=3.

[Acryl monomer of formula (7)]

(7)

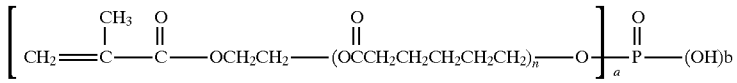

wherein n=0, $\overline{a}=2$, and $\overline{b}=1$.

[Acryl monomer of formula (8)]

(8)

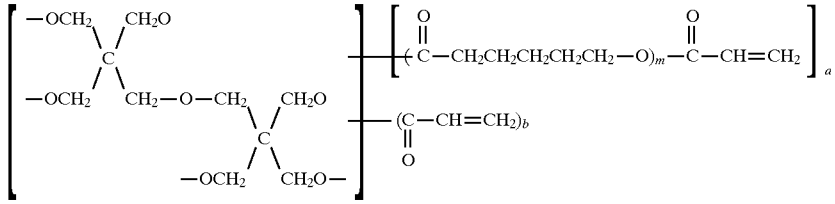

wherein m is an integer of 1 or 2, a is an integer of 2 to 6, and b is an integer of 0 to 4.

[Acryl monomer of formula (9)]

(9)

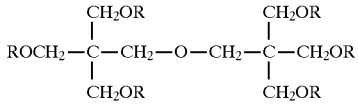

wherein R is acryloyl group, hydroxyl group or alkynoyl group.

When the above-mentioned acryl monomer is cured, a conventionally known photopolymerization initiator such as benzophenone may be used, with a sensitizer being optionally added thereto. The ultraviolet curing nay be carried out under the conditions that the intensity of irradiation is in the range of 8 to 200 W/cm, and the transportation speed is 1 to 20 m/min. This curing treatment may be carried out in an atmosphere of nitrogen.

Figure 1:
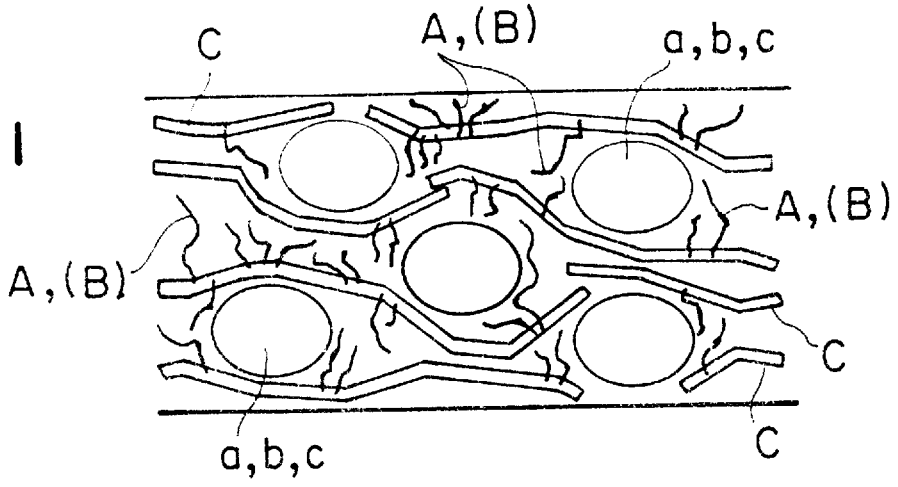
FIG. 1 is a schematic cross-sectional view of a reversible thermosensitive recording layer of a reversible thermosensitive recording material according to the present invention, in which each of the resin aggregates of a dispersion resin C is in the form of a plate.
Figure 2:
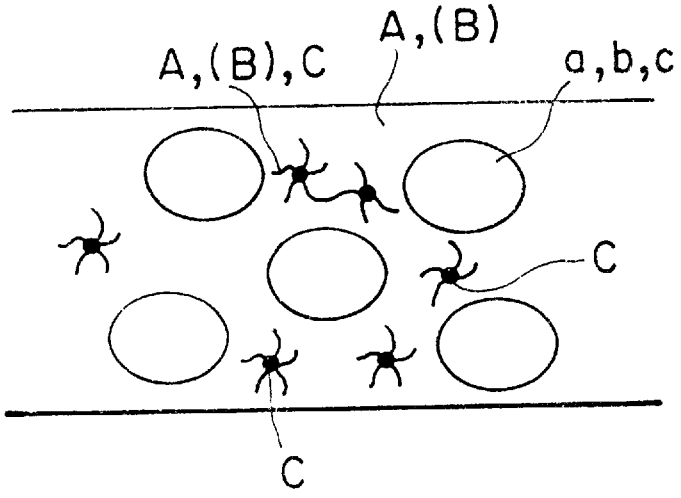
FIG. 2 is a schematic cross-sectional view of a reversible thermosensitive recording layer of a reversible thermosensitive recording material according to the present invention, in which each of the resin aggregates of a dispersion resin C is in the form of a microgel.

Furthermore, it is advantageous that the additional matrix resin component B be used in combination with the matrix resin A, as shown in FIGS. 1 and 2. In this case, it is preferable that the above-mentioned additional matrix resin component B have a glass transition temperature lower than that of the matrix resin A, and a thermal conductivity lower than that of the matrix resin, A.

Such an additional matrix resin component B is more easily affected by thermal energy than the matrix resin A, and more subject to deformation by the application of pressure thereto when the thermal energy is selectively applied to the recording layer using a thermal head. As a result, owing to the presence of the additional matrix resin component B, the function of the matrix resin A can be prevented from being impaired when the thermal energy and pressure are repeatedly applied to the recording layer. Therefore, the range of applied thermal energy where the image erasure can be performed can be extended to improve the erasing performance, and such thermal energy range for image erasure can be stably maintained even after the repeated image forming and erasing operations.

As such an additional matrix resin component B, for example, there can be employed a copolymer of vinyl chloride and vinyl ester of fatty acid having 3 or more carbon atoms; a terpolymer of vinyl chloride, ethylene, and a monomer, dimer, trimer or oligomer having an aliphatic group moiety and an acid group moiety; and a copolymer of vinyl chloride and a monomer, diner, trimer or oligomer having an aliphatic group moiety, and an acid group moiety (and/or acid residue).

The low-molecular weight material is dispersed in the reversible thermosensitive recording layer. In the present invention, it is preferable that the low-molecular weight material comprise the following three low-molecular weight material components (a), (b) and (c):

(a) a monocarboxylic acid having a melting point a of 60° to 90° C., (b) a low-molecular weight material component selected from the group consisting of a fatty acid ester, a difatty acid ester of polyhydric alcohol, and a dibasic acid ester, each having a melting point b of 50° to 80° C., and (c) an aliphatic saturated dicarboxylic acid having a melting point c of 100° to 130° C., with the melting points a, b and c being in the relationship of b<a<c.

In the conventional reversible thermosensitive recording layer, the improvement of image contrast and the extension of the above-mentioned thermal energy range for image erasure are limited. Even if the thermal energy range for image erasure can be extended, it is not suitable under the general operating temperature of 0° to 40° C. In addition, the image density of the image recorded in the conventional reversible thermosensitive recording layer is decreased during the storage thereof. In the present invention, however, when the above-mentioned low-molecular weight material components (a), (b) and (c) are used in combination in the recording layer, the conventional problems can be solved.

In order to obtain a uniformly coated recording layer with excellent film-forming properties, it is desirable that the melting point of the employed low-molecular weight material component (a) be in the range of 60° to 90° C., and the melting point of the employed low-molecular weight material component (b) be in the range of 50° to 80° C., and that the low-molecular weight material component (a) be compatible with the low-molecular weight material component (b). The crystallizing speed of the low-molecular weight material component (a) and that of the low-molecular weight material component (b) in the recording layer vary because their melting points are different.

Further, the melting point of the low-molecular weight material component (c) has an effect on the extension of the thermal energy range for image erasure. It is preferable that the melting point of the low-molecular weight material component (c) be in the range of 100° to 130° C. When the melting point of the employed low-molecular weight material component (c) is too high, the thermal energy necessary for the image formation is increased, so that the life of the thermal head is curtailed, and the surface layer of the reversible thermosensitive recording material tends to deteriorate very easily.

In light of the above-mentioned various factors, it is preferable to select the low-molecular weight material components a, b and c so that the melting points a, b and c of the low-molecular weight material components a, b and c may be in the relationship of b<a<c.

Specific examples of the low-molecular weight material component (a) include fatty acids such as lauric acid, myristic acid, pentadecanoic acid, palmitic acid, stearic acid, behenic acid, nonadecanoic acid, arachic acid, heneicosanoic acid, tricosanoic acid, lignoceric acid, pentacosanoic acid, cerotic acid, heptacosanoic acid, montanic acid, melissic acid, and oleic acid.

The fatty acid ester serving as the low-molecular weight material component (b) for use in the present invention is, for example, represented by the following formula:

$$R^1—COO—R^2$$

wherein $R^1$ and $R^2$ are each an alkyl group having 10 or more carbon atoms.

It is preferable that the number of carbon atoms in the above-mentioned fatty acid ester be 20 or more, more preferably 25 or more, and further preferably 30 or more. With the increase of the number of carbon atoms in the above-mentioned fatty acid ester, the degree of milky opaque whiteness of the recording layer can be increased, and the durability of the recording layer can be improved.

Specific examples of the fatty acid ester are as follows: octadecyl laurate, docosyl laurate, docosyl myristate, dodecyl palmitate, tetradecyl palmitate, pentadecyl palmitate, hexadecyl palmitate, octadecyl palmitate, triacontyl palmitate, octadecyl palmitate, docosyl palmitate, vinyl stearate, propyl stearate, isopropyl stearate, butyl stearate, amyl stearate, heptyl stearate, octyl stearate, tetradecyl stearate, hexadecyl stearate, heptadecyl stearate, octadecyl stearate, docosyl stearate, hexacosyl stearate, triacontyl stearate, dodecyl behenate, octadecyl behenate, docosyl behenate, tricosyl lignocerate, and myricyl melissinate.

Those fatty acid esters may be used alone or in combination.

The difatty acid ester of polyhydric alcohol serving as the low-molecular weight material component (b) for use in the present invention is represented by the following formula:

$$CH_3(CH_2)_m—COO(CH_2)_nOOC(CH_2)_m—CH_3$$

wherein n is an integer of 2 to 40, preferably 3 to 30, and further preferably 4 to 22; and m is an integer of 0 to 38, preferably 1 to 28, and further preferably 2 to 20.

Specific examples of the difatty acid ester of polyhydric alcohol represented by the aforementioned formula are as follows:

1,2-ethanediol dialkanoic acid ester, 1,3-propanediol dialkanoic acid ester, 1,4-butanediol dialkanoic acid ester, 1,5-pentanediol dialkanoic acid ester, 1,6-hexanediol dialkanoic acid ester, 1,7-heptanediol dialkanoic acid ester, 1,8-octanediol dialkanoic acid ester, 1,9-nonanediol dialkanoic acid ester, 1,10-decanediol dialkanoic acid ester, 1,11-undecanediol dialkanoic acid ester, 1,12-dodocanediol dialkanoic acid ester, 1,13-tridecanediol dialkanoic acid ester, 1,14-tetradecanediol dialkanoic acid ester, 1,15-pentadecanediol dialkanoic acid ester, 1,16-hexadecanediol dialkanoic acid ester, 1,17-heptadecanediol dialkanoic acid ester, 1,18-octadecanediol dialkanoic acid ester, 1,19-nonadecanediol dialkanoic acid ester, 1,20-eicosanediol dialkanoic acid ester, 1,21-heneicosanediol dialkanoic acid ester, 1,22-docosanediol dialkanoic acid ester, 1,23-tricosanediol dialkanoic acid ester, 1,24-tetracosanediol dialkanoic acid ester, 1,25-pentacosanediol dialkanoic acid ester, 1,26-hexacosanediol dialkanoic acid ester, 1,27-heptacosanediol dialkanoic acid ester, 1,28-octacosanedlol dialkanoic acid ester, 1,29-nonacosanediol dialkanoic acid ester, 1,30-triacontanediol dialkanoic acid ester, 1,31-hentriacontanediol dialkanoic acid ester, 1,32-dotriacontanediol dialkanoic acid ester, 1,33-tritriacontanediol dialkanoic acid ester, and 1,34-tetratriacontanediol dialkanoic acid ester.

The dibasic acid ester serving as the low-molecular weight material component (b), which may be a monoester or diester, is represented by the following formula:

$$R—OOC—(CH_2)_n—COOR'$$

wherein R and R' are each a hydrogen atom or an alkyl group having 1 to 30 carbon atoms, preferably 1 to 22, which may be the same or different, provided that R and R' cannot be a hydrogen atom at the same time; and n is an integer of 0 to 40, preferably 1 to 30, and more preferably 2 to 20.

Specific examples of the dibasic acid ester are as follows: oxalate, malonate, succinate, glutarate, adipate, pimelate, suberate, azelate, sebacate, 1-,9-nonamethylene dicarbonate, 1-,10-decamethylene dicarbonate, 1-,11-undecamethylene dicarbonate, 1- ,12-dodecamethylene dicarbonate, 1-,13-tridecamethylene dicarbonate, 1-,14-tetradecamethylene dicarbonate, 1-,15-pentadecamethylene dicarbonate, 1-,16-hexadecamethylene dicarbonate, 1-,17-heptadecamethylene dicarbonate, 1-, 18-octadecamethylene dicarbonate, 1-,19-nonadecamethylene dicarbonate, 1-, 20-eicosamethylene dicarbonate, 1-, 21-heneicosamethylene dicarbonate, 1-,22-docosamethylene dicarbonate, 1-,24-tetracosamethylene dicarbonate, 1-,28-octacosamethylene dicarbonate, and 1-,32-dotriacontamethylene dicarbonate.

As previously mentioned, the low-molecular weight material component (c) is used in combination with the low-molecular weight material components (a) and (b) in the reversible thermosensitive recording layer.

Examples of the low-molecular weight material component (c) include an aliphatic saturated dicarboxylic acid, but are not limited to such a compound.

Specific examples of the aliphatic saturated dicarboxylic acid serving as the low-molecular weight component (c) are as follows:

succinic acid, glutaric acid, adipic acid, pimelic acid, suberic acid, azelaic acid, sebacic acid, undecanedioic acid, dodecanedioic acid, tetradecanedioic acid, pentadecanedioic acid, hexadecanedioic acid, heptadecanedioic acid, octadecanedioic acid, nonadecanedioic acid, eicosanedioic acid, heneicosanedioic acid, and docosanedioic acid.

It is preferable that the thickness of the reversible thermosensitive recording layer be in the range of 1 to 30 $\mu$m, and more preferably in the range of 2 to 20 $\mu$m. When the reversible thermosensitive recording layer is excessively thick, the thermal distribution in the recording layer becomes non-uniform, so that it becomes difficult to uniformly make the recording layer transparent. On the other hand, when the reversible thermosensitive recording layer is too thin, the degree of milky whiteness of the recording layer is decreased, so that the image contrast is lowered. The milky whiteness degree of the recording layer can be increased by increasing the amount of organic low-molecular weight material in the recording layer.

In order to increase the adhesion between the support and the reversible thermosensitive recording layer, an adhesive layer may be provided between the support and the recording layer.

In this case, there can be employed any resins that have adequate adhesion to the support material and do not have an adverse effect on the components for use in the recording layer. For example, vinyl chloride resin, polyester resin, acrylic resin, and polyamide resin can be preferably employed. In particular, when a metal plate is used as the support or a metal thin film is deposited on the support, a copolymer comprising vinyl chloride and phosphoric ester is most advantageous as the material for the adhesive layer.

It is preferable that the thickness of the adhesive layer be in the range of 0.1 to 5 $\mu$m, more preferably in the range of 0.3 to 2 $\mu$m.

In the case where images formed in this reversible thermosensitive recording material are used as reflection images, it is preferable to place a light reflection layer behind the reversible thermosensitive recording layer. When such a light reflection layer is provided, the image contrast can be increased even when the reversible thermosensitive recording layer is thin. Such a light reflection layer can be made by deposition of Al, Ni or Sn as disclosed in Japanese Laid-Open Patent Application 64-14079.

Furthermore, it is possible to fabricate an information recording card by providing the above-mentioned reversible thermosensitive recording layer and a magnetic recording layer in the recording material of the present invention. In the case where the reversible thermosensitive recording layer is provided on the magnetic recording layer, the card may be fabricated is disclosed in Japanese Laid-Open Utility Model Application 2-3876. To be more specific, a smoothing layer comprising a resin as the main component is provided on the magnetic recording layer to make the surface of the magnetic recording layer smooth, the light reflection layer is provided thereon, and the reversible thermosensitive recording layer is provided on the light reflection layer via the adhesive layer when necessary. In addition, the above-mentioned information recording card may be further provided with an optical recording layer, a thermosensitive recording layer comprising a color developer and a leuco dye, and an IC recording layer.

Further, a protective layer may be provided on the reversible thermosensitive recording layer. By the provision of the protective layer, deformation of the recording layer, which might be caused by the application of heat and pressure thereto, can be prevented when the writing and erasing operations are repeatedly carried out using heat-application means such as a thermal head. As a result, the decrease of transparency of a transparent portion can be prevented.

Examples of the material for the protective layer include silicone rubber and silicone resin (as disclosed in Japanese Laid-Open Patent Application 63-221087), polysiloxane graft polymer (as disclosed in Japanese Laid-Open Patent Application 63-317385), and ultraviolet curing resin and electron irradiation curing resin (as disclosed in Japanese Laid-Open Patent Application 2-566).

The protective layer may further comprise a filler and a lubricant for improving the transporting performance of the obtained recording material.

When the protective layer is overlaid on the recording layer using the above-mentioned materials, a solvent is employed for coating. Therefore, it is desirable to employ a solvent in which resin components and low-molecular weight material components for use in the reversible thermosensitive recording layer are not soluble or slightly soluble.

Specific examples of such a solvent include n-hexane, methyl alcohol, ethyl alcohol and isopropyl alcohol. In view of the cost, alcohol solvents are preferable.

It is preferable that the thickness of the protective layer be in the range of 0.1 to 5 $\mu$m.

In order to protect the reversible thermosensitive recording layer from the solvent and/or monomer components which are employed for the formation of the protective layer, an intermediate layer may be interposed between the protective layer and the reversible thermosensitive recording layer, as disclosed in Japanese Laid-open Patent Application 1-133781. As the material for the intermediate layer, the same resin materials as those for the formation of the reversible thermosensitive recording layer can be employed, In addition to those resin materials, there can be employed the following thermosetting resins and thermoplastic resins: polyethylene, polypropylene, polystyrene, polyvinyl alcohol, polyvinyl butyral, polyurethane, saturated polyester, unsaturated polyester, epoxy resin, phenolic resin, polycarbonate, and polyamide.

The thickness of the intermediate layer, which varies depending upon the application of the recording material, is preferably in the range of 0.1 to 2 $\mu$m. When the thickness of the intermediate layer is within the above-mentioned range, the intermediate layer can function to protect the recording layer without decreasing the thermal sensitivity.

Furthermore, in order to make the images formed in the reversible thermosensitive recording layer clear and more easily visible, a colored layer may be interposed between the support and the recording layer.

To increase the image contrast, an air layer with a low refractive index may be provided between the support and the recording layer, or between the light reflection layer (or the colored layer) and the recording layer.

To form images in the reversible thermosensitive recording layer of the recording material according to the present invention, a thermal head may be employed under such a condition that the applied energy is 0.2 to 0.3 mJ/dot at a pulse width of 2 to 5 msec. Further, a thermal head or ceramic bar can be used as the image erasing means. Therefore, the image formation and erasure apparatus for the recording material of the present invention can be made compact and light. When the recorded image is erased using the thermal head, the applied energy may be controlled to 0.5 to 1.0 mJ/dot at a pulse width of 10 to 20 msec. In the case where the ceramic bar is used for image erasure, the surface temperature of the ceramic bar may be controlled to 100° to 110° C. and the transportation speed of the recording material may be controlled to 10 to 50 mm/sec when the width of the employed ceramic bar is in the range of 1 to 5 mm. The pressure applied to the recording material may be optimized depending on the structure of the employed reversible thermosensitive recording material.

Other features of this invention will become apparent in the course of the following description of exemplary embodiments, which are given for illustration of the invention and are not intended to be limiting thereof.

EXAMPLE 1

Aluminum was deposited on the polyethylene terephthalate (PET) side of a commercially available PET sheet (Trademark "DS-1711", made by Dainippon Ink & Chemicals, Incorporated) prepared by attaching a magnetic layer to a PET film.

[Formation of adhesive layer]

The following components were mixed to prepare a coating liquid for an adhesive layer:

| | Parts by Weight |
|---|---|
| Vinyl chloride-vinyl acetate-phosphoric ester copolymer (Trademark "1000P", made by Denki Kagaku Kogyo K.K.) | 5 |
| Methyl ethyl ketone (MEK) | 20 |
| Toluene | 20 |

The above prepared adhesive layer coating liquid was coated on the aluminum-deposited surface of the above-mentioned PET film by microgravure coating method, and dried at 130° C., so that an adhesive layer with a thickness of 1 to 2 μm was provided on the aluminum deposited PET film.

[Formation of reversible thermosensitive recording layer]

The following components were mixed to prepare a coating liquid for a reversible thermosensitive recording layer:

| | Parts by Weight |
|---|---|
| (Matrix resin A) Vinyl chloride-vinyl acetate copolymer (Trademark "Denka 1000MT2", made by Denki Kagaku Koqyo K.K.) [Tg: 70° C.] | 100 |
| (Dispersion resin C) Acrylic monomer (Trademark "DPCA120", made by Nippon Kayaku Co., Ltd.) [Tg of the obtained polymer: 180° C.] | 20 |
| 1-hydroxycyclohexyl-phenyl ketone (Trademark "IRGACURE 184", made by Ciba-Geigy, Ltd.) | 0.2 |
| 1,4-butanediol distearate [mp: 70° C.] | 2 |
| Behenic acid [mp: 78° C.] | 6 |
| Eicosanedioic acid [mp: 122° C.] | 10 |
| Silicone oil (Trademark "ST102PA", made by Toray Silicone Co., Ltd.) | 0.01 |
| Tetrahydrofuran (THF) | 360 |
| n-amyl alcohol | 42 |

The above-prepared coating liquid for the recording layer was coated on the adhesive layer using an extruder die, and dried at 120° C. Immediately after that, the coated liquid was cooled to a temperature in the range of about 60° to 90° C. so that the coated liquid for the recording layer might riot assume completely white opaque state. At that time, the coated liquid was cured by the UV application under the conditions that the intensity of irradiation was 120 W/cm and the scanning speed was 10 m/min. Thus, a reversible thermosensitive recording layer with a thickness of 10 to 11 μm was provided on the adhesive layer.

Figure 4:
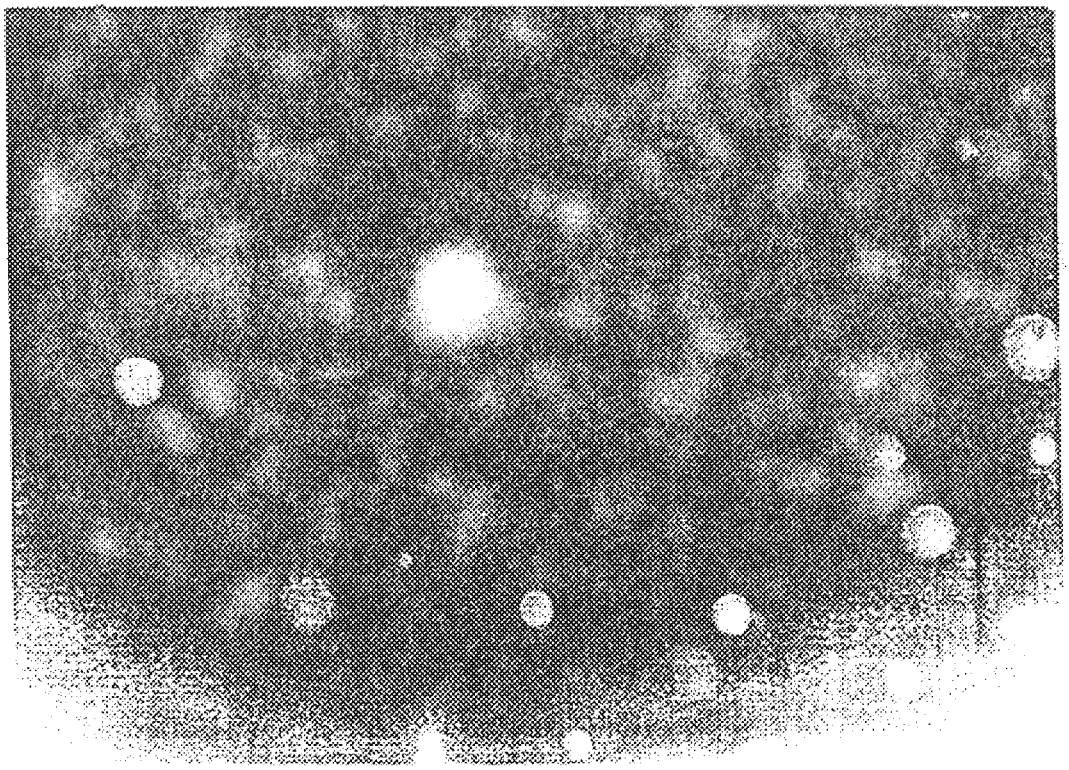
FIG. 4 is an electron micrograph of a reversible thermosensitive recording layer of a recording material according to the present invention.

It was confirmed that the acrylic resin prepared by curing the acryl monomer was dispersed in the matrix resin and each resin aggregate of the acrylic resin was in the form of a microgel as shown in FIG. 2 or FIG. 4.

In FIG. 2, a, b and c indicate low-molecular weight material components,

[Formation of protective layer]

A mixture of the following components was dispersed in a ball mill to prepare a coating liquid for a protective layer:

| | Parts by Weight |
|---|---|
| Acrylic resin (Trademark "C7-157", made by Dainippon Ink & Chemicals, Incorporated) | 10 |
| Isopropyl alcohol | 10 |
| Calcium carbonate | 3 |

The above prepared protective layer coating liquid was coated on the reversible thermosensitive recording layer using a wire bar, dried at 90° C., and then cured by the UV application under the conditions that the intensity of irradiation was 80 W/cm and the scanning speed was 10 m/min, whereby a protective layer with a thickness of 2 to 3 μm was provided on the reversible thermosensitive recording layer.

Thus, a reversible thermosensitive recording material No. 1 according to the present invention was fabricated.

Before the protective layer was provided on the reversible thermosensitive recording layer, the recording layer was dissolved in tetrahydrofuran. The resulting insoluble matter was collected into a dropping pipette, and observed using an electron microscope. As a result, there were observed resin aggregates in the form of a microgel (with a particle diameter ranging from 250 to 2000 Å), as shown in FIG. 5.

EXAMPLE 2

The procedure for fabrication of the reversible thermosensitive recording material No. 1 in Example 1 was repeated except that the formulation for the reversible thermosensitive recording layer coating liquid was changed to the following formulation:

(Formulation for reversible thermosensitive recording layer coating liquid)

| | Parts by Weight |
|---|---|
| (Matrix resin A) Vinyl chloride-vinyl acetate copolymer (Trademark Denka "1000MT2", made by Denki Kagaku Kogyo K.K.) [Tg: 70° C.] | 60 |
| (Dispersion resin C) Acrylic monomer (Trademark "DPCA120", made by Nippon Kayaku Co., Ltd.) [Tg of the obtained polymer: 180° C.] | 10 |
| 1-hydroxycyclohexyl-phenyl ketone (Trademark "IRGACURE 184", made by Ciba-Geigy, Ltd.) | 0.1 |
| 1,4-butanediol distearate [mp: 70° C.] | 2 |
| Behenic acid [mp: 78° C.] | 6 |
| Eicosanedioic acid [mp: 122° C.] | 10 |
| Silicone oil (Trademark "ST102PA", made by Toray Silicone Co., Ltd.) | 0.01 |
| THF | 360 |
| n-amyl alcohol | 40 |

Thus, a reversible thermosensitive recording material No. 2 according to the present invention was fabricated.

It was confirmed that the acrylic resin prepared by curing the acryl monomer was dispersed in the matrix resin in the recording layer, and each resin aggregate of the acrylic resin was in the form of a plate as shown in FIG. 1.

In FIG. 1, a, b and c indicate low-molecular weight material components.

In addition, before the protective layer was provided on the reversible thermosensitive recording layer, the recording layer was dissolved in tetrahydrofuran. The resulting insoluble matter was collected into a dropping pipette, and observed using an electron microscope. As a result, there were observed resin aggregates in the form of a plate, as shown in FIG. 6.

EXAMPLE 3

The procedure for fabrication of the reversible thermosensitive recording material No, 2 in Example 2 was repeated except that the formulation for the reversible thermosensitive recording layer coating liquid was changed to the following formulation:

(Formulation for reversible thermosensitive recording layer coating liquid)

| | Parts by Weight |
|---|---|
| (Matrix resin A) Vinyl chloride-vinyl acetate copolymer (Trademark Denka "1000MT2", made by Denki Kagaku Kogyo K.K.) [Tg: 70° C.] | 60 |
| (Dispersion resin C) Acrylic monomer (Trademark "DHPA", made by Nippon Kayaku Co., Ltd.) [Tg of the obtained polymer: 200° C. or more] | 10 |
| 1-hydroxycyclohexyl-phenyl ketone (Trademark "IRGACURE 184", made by Ciba-Geigy, Ltd.) | 0.1 |
| 1,4-butanediol distearate [mp: 70° C.] | 2 |
| Lignoceric acid [mp: 80° C.] | 6 |
| Eicosanedioic acid [mp: 122° C.] | 10 |
| Silicone oil (Trademark "ST102PA", made by Toray Silicone Co., Ltd.) | 0.01 |
| THF | 360 |
| n-amyl alcohol | 40 |

Thus, a reversible thermosensitive recording material No. 3 according to the present invention was fabricated.

It was confirmed that the acrylic resin prepared by curing the acryl monomer was dispersed in the matrix resin in the recording layer, and each resin aggregate of the acrylic resin was in the form of a plate as shown in FIG. 1.

In addition, before the protective layer was provided on the reversible thermosensitive recording layer, the recording layer was dissolved in tetrahydrofuran. The resulting insoluble matter was collected into a dropping pipette, and observed using an electron microscope. As a result, there were observed resin aggregates in the form of a plate, as shown in FIG. 6.

It was confirmed that those resin aggregates included acryl polymer and were in an amount of 20 parts by weight.

EXAMPLE 4

The procedure for fabrication of the reversible thermosensitive recording material No. 3 in Example 3 was repeated except that the formulation for the reversible thermosensitive recording layer coating liquid was changed to the following formulation:

(Formulation for reversible thermosensitive recording layer coating liquid)

| | Parts by Weight |
|---|---|
| Matrix resin (A) Vinyl chloride-vinyl acetate copolymer (Trademark "Denka 1000MT2", made by Denki Kagaku Kogyo K.K.) [Tg: 70° C.] | 40 |
| Additional matrix resin component (B) Vinyl chloride-vinyl propionate copolymer (Trademark "QS530", made by Tosoh Corporation [Tg: 60° C.] | 20 |
| Dispersion resin (C) | 10 |

-continued

| | Parts by Weight |
|---|---|
| Acrylic monomer (Trademark "DPHA", made by Nippon Kayaku Co., Ltd.) [Tg of the obtained polymer: 200° C. or more] | |
| 1-hydroxycyclohexyl-phenyl ketone (Trademark "IRGACURE 184", made by Ciba-Geigy, Ltd.) | 0.1 |
| 1,4-butanediol distearate [mp: 70° C.] | 2 |
| Lignoceric acid [mp: 80° C.] | 6 |
| Eicosanedioic acid [mp: 122° C.] | 10 |
| Silicone oil (Trademark "ST102PA", made by Toray Silicone Co., Ltd.) | 0.01 |
| THF | 360 |
| n-amyl alcohol | 40 |

Thus, a reversible thermosensitive recording material No. 4 according to the present invention was fabricated.

It was confirmed that the acrylic resin prepared by curing the acryl monomer was dispersed in the matrix resin in the recording layer, and each resin aggregate of the acrylic resin was in the form of a plate as shown in FIG. 1.

In addition, before the protective layer was provided on the reversible thermosensitive recording layer, the recording layer was dissolved in tetrahydrofuran. The resulting insoluble matter was collected into a dropping pipette, and observed using an electron microscope. As a result, there were observed resin aggregates in the form of a plate, as shown in FIG. 6.

EXAMPLE 5

The procedure for fabrication of the reversible thermosensitive recording material No. 3 in Example 3 was repeated except that the formulation for the reversible thermosensitive recording layer coating liquid was changed to the following formulation:

(Formulation for reversible thermosensitive recording layer coating liquid)

| | Parts by Weight |
|---|---|
| Matrix resin (A) Vinyl chloride-vinyl acetate copolymer (Trademark "Denka 1000MT", made by Denki Kagaku Kogyo K.K.) [Tg: 79° C.] | 40 |
| Additional matrix resin component (B) Vinyl chloride-vinyl acetate copolymer (Trademark "Denka 1000MT3", made by Denki Kagaku Kogyo K.K.) [Tg: 65° C.] | 20 |
| Dispersion resin (C) Acrylic monomer (Trademark "DPHA", made by Nippon Kayaku Co., Ltd.) [Tg of the obtained polymer: 200° C. or more] | 10 |
| 1-hydroxycyclohexyl-phenyl ketone (Trademark "IRGACURE 184", made by Ciba-Geigy, Ltd.) | 0.1 |
| 1,4-butanediol distearate [mp: 70° C.] | 2 |
| Lignoceric acid [mp: 80° C.] | 6 |
| Eicosanedioic acid [mp: 122° C.] | 10 |
| Silicone oil (Trademark "ST102PA", made by Toray Silicone Co., Ltd.) | 0.01 |
| THF | 360 |
| n-amyl alcohol | 40 |

Thus, a reversible thermosensitive recording material No. 5 according to the present invention was fabricated.

It was confirmed that the acrylic resin prepared by curing the acryl monomer was dispersed in the matrix resin in the recording layer, and each resin aggregate of the acrylic resin was in the form of a plate as shown in FIG. 1.

In addition, before the protective layer was provided on the reversible thermosensitive recording layer, the recording layer was dissolved in tetrahydrofuran. The resulting insoluble matter was collected into a dropping pipette, and observed using an electron microscope. As a result, there were observed resin aggregates in the form of a plate, as shown in FIG. 6.

COMPARATIVE EXAMPLE 1

The procedure for fabrication of the reversible thermosensitive recording material No. 2 in Example 2 was repeated except that 1-hydroxycyclohexyl-phenyl ketone (Trademark "IRGACURE 184") employed in the formulation for the reversible thermosensitive recording layer coating liquid in Example 2 was removed therefrom, and that the reversible thermosensitive recording layer coating liquid thus prepared was cured by electron beam irradiation under the conditions that the accelerating voltage was set to 100 kV, the irradiation dose was set to 10 Mrad and the irradiation speed was set to 10 m/min.

Thus, a comparative reversible thermosensitive recording material No. 1 was fabricated.

COMPARATIVE EXAMPLE 2

The procedure for fabrication of the reversible thermosensitive recording material No. 2 in Example 2 was repeated except that acrylic monomer (Trademark "DPCA120") and 1-hydroxycyclohexyl-phenyl ketone (Trademark "IRGACURE 184") employed in the formulation for the reversible thermosensitive recording layer coating liquid in Example 2 were removed therefrom, and the amount of vinyl chloride—vinyl acetate copolymer (Trademark "1000MT2") was changed from 60 to 70 parts by weight, and that the reversible thermosensitive recording layer coating liquid thus prepared was coated on the adhesive layer, and dried without the ultraviolet curing treatment.

Thus, a comparative reversible thermosensitive recording material No. 2 was fabricated.

Using the above prepared reversible thermosensitive recording materials No. 1 to No. 5 according to the present invention and comparative reversible thermosensitive recording materials No. 1 and No. 2, the following evaluation tests were conducted:

(1) Erasing Performance

Immediately after each recording material was fabricated, the recording layer assumed a transparent state. White opaque images were formed in the recording layer, and then those white opaque images were erased therefrom using an edge-type thermal head of 1400 Ω at a pulse width of 20 msec. At that timer the permissible thermal energy range for image erasure operation was obtained.

Figure 7:
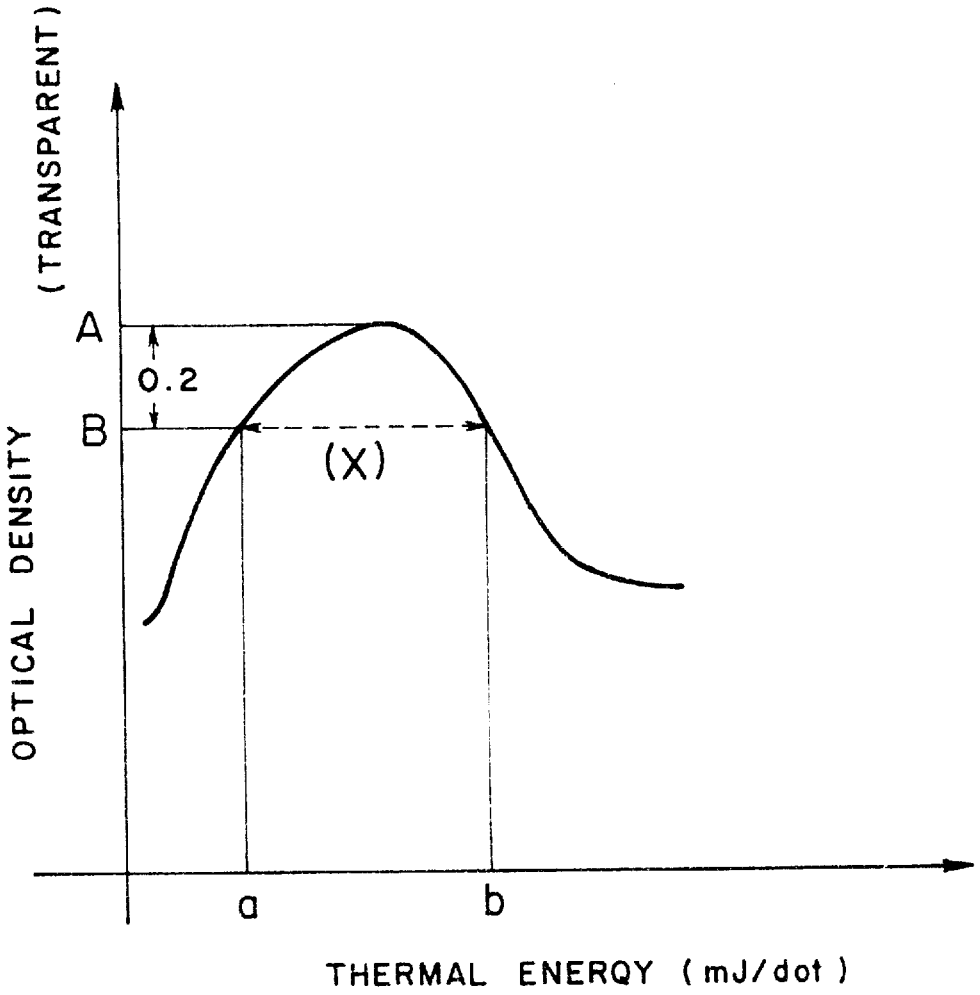
FIG. 7 is a graph which shows the relationship between the thermal energy applied to the recording layer for image erasure operation and the optical density, in explanation of the permissible range of thermal energy for image erasure operation.

To be more specific, as shown in FIG. 7, the optical density of a white opaque image portion is increased with elevating the thermal energy (mJ/dot) applied thereto. When the thermal energy applied to the white opaque image portion is increased to "a", the optical density B can be obtained. In this graph, the optical density A is a reflectance of the aluminum-deposited surface (namely, about 1.10 to 1.15) of the PET film. In other words, when the optical density A is obtained, a white opaque image is completely erased, that is, perfectly made transparent, Generally, it is considered that erasure of the white opaque image portion can be achieved when the optical density of the image portion is in the range of B to A. Therefore, corresponding to the optical density B to A, the range of thermal energy "a" to "b", represented by (x) in the graph, is defined to be a permissible range of thermal energy for image erasure operation.

In addition, the above-specified permissible thermal energy range for erasing the white opaque image was obtained after the white opaque image was allowed to stand at 50° C. for 7 days.

The results are shown in Table 1.

(2) Durability of Recording Layer

Each reversible thermosensitive recording material was processed so as to have a card size of 5.5×8.6 cm. Then, white opaque images were formed in the recording material and erased therefrom using a commercially available thermal printer "R3000" (Trademark), made by PANASONIC. The optical density of a white opaque image portion first formed in the recording layer was measured using a McBeth densitometer RD914. After the image formation and erasure was repeated 500 times, the optical density of the obtained white opaque image portion was measured similarly.

The results are shown in Table 1.

(3) Dynamic Viscoelasticity

The dynamic viscoelasticity of the resin composition of each recording layer was measured using a commercially available measuring instrument "TMA" (Trademark), made by Seiko instruments Inc.

The results are shown in Table 1.

TABLE 1

| | Erasing Performance (Thermal Energy Range "x" in FIG. 7) | | Durability of Recording Layer | | Dynamic Visco-elasticity (dyn/cm$^2$) |
|---|---|---|---|---|---|
| | 1st Operation | After Storage | 1st Operation | After 500th Operation | |
| Ex. 1 | 0.15 | 0.13 | 0.25 | 0.46 | $10^6$ |
| Ex. 2 | 0.15 | 0.13 | 0.25 | 0.42 | $10^6$ |
| Ex. 3 | 0.15 | 0.13 | 0.25 | 0.39 | $10^6$ |
| Ex. 4 | 0.15 | 0.15 | 0.26 | 0.42 | $10^6$ |
| Ex. 5 | 0.15 | 0.13 | 0.25 | 0.40 | $10^6$ |
| Comp. Ex. 1 | 0.15 | 0.14 | 0.25 | 0.35(*) | $10^6$ |
| Comp. Ex. 2 | 0.15 | 0.10 | 0.25 | 0.70 | — |

(*)After the repetition of image formation and erasure, cracks were observed in the reversible thermosensitive recording layer, and the aluminum layer provided under the recording layer was caused to deteriotate.

As previously explained, when the reversible thermosensitive recording material according to the present invention is used, the erasing performance is excellent and such excellent erasing performance can be maintained even though the recorded image is allowed to stand at high temperature for 7 days. In addition, the durability of the recording layer is improved.

What is claimed is:

1. A reversible thermosensitive recording material comprising a support and a reversible thermosensitive recording layer formed thereon, capable of reversibly assuming at least two different visible states depending upon the temperature thereof, comprising an organic low-molecular weight material and a resin composition in which said organic low-molecular weight material is dispersed, said resin composition comprising:

a matrix resin, and a dispersion resin having a glass transition temperature higher than that of said matrix resin, and comprising resin aggregates which are separately dispersed in said matrix resin in such a manner that said resin aggregates are associated with said matrix resin.

2. The reversible thermosensitive recording material as claimed in claim 1, wherein said resin aggregates are formed into groups which are separately dispersed in said matrix resin.

3. The reversible thermosensitive recording material as claimed in claim 1, wherein each of said resin aggregates is in the form of a microgel.

4. The reversible thermosensitive recording material as claimed in claim 1, wherein each of said resin aggregates is in the form of a plate.

5. The reversible thermosensitive recording material as claimed in claim 1, wherein said dispersion resin has a glass transition temperature of 180° C. or more.

6. The reversible thermosensitive recording material as claimed in claim 1, wherein said dispersion resin is prepared by curing an acryl monomer selected from the group consisting of acryl ester and acryl urethane.

7. The reversible thermosensitive recording material as claimed in claim 1, wherein the amount ratio by weight of said dispersion resin to said matrix resin is in the range of (1:99) to (40:60).

8. The reversible thermosensitive recording material as claimed in claim 1, wherein said resin composition further comprises an additional matrix resin component which has a glass transition temperature lower than that of said matrix resin.

9. The reversible thermosensitive recording material as claimed in claim 1, wherein said resin composition has a dynamic viscoelasticity in a range of $10^5$ dyn/cm$^2$ to less than $10^7$ dyn/cm$^2$.

10. The reversible thermosensitive recording material as claimed in claim 1, wherein said low-molecular weight material comprises:

(a) a monocarboxylic acid having a melting point $\underline{a}$ of 60° to 90° C., (b) a low-molecular weight material component selected from the group consisting of a fatty acid ester, a difatty acid ester of polyhydric alcohol, and a dibasic acid ester, each having a melting point $\underline{b}$ of 50° to 80° C., and (c) an aliphatic saturated dicarboxylic acid having a melting point $\underline{c}$ of 100° to 130° C., with said melting points $\underline{a}$, $\underline{b}$ and $\underline{c}$ being in the relationship of $\underline{b}<\underline{a}<\underline{c}$.

* * * * *